US011702752B2

(12) United States Patent
Iisaka

(10) Patent No.: US 11,702,752 B2
(45) Date of Patent: Jul. 18, 2023

(54) METHOD FOR FORMING METAL PLATING FILM

(71) Applicant: TOYOTA JIDOSHA KABUSHIKI KAISHA, Toyota (JP)

(72) Inventor: Hirofumi Iisaka, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/007,018

(22) Filed: Aug. 31, 2020

(65) Prior Publication Data

US 2021/0079531 A1 Mar. 18, 2021

(30) Foreign Application Priority Data

Sep. 13, 2019 (JP) ..... 2019-167331

(51) Int. Cl.
*C23C 18/42* (2006.01)
*C23C 18/54* (2006.01)
(Continued)

(52) U.S. Cl.
CPC ..... *C23C 28/023* (2013.01); *C23C 18/1653* (2013.01); *C23C 18/34* (2013.01);
(Continued)

(58) Field of Classification Search
CPC ..... C23C 18/34; C23C 18/44; C23C 18/54; C23C 18/32; C23C 18/42; C23C 18/1619; C23C 28/023; C23C 30/00; C23C 18/1653
See application file for complete search history.

(56) References Cited

U.S. PATENT DOCUMENTS 4,100,331 A 7/1978 Ingham et al.
4,137,136 A * 1/1979 Ueda ..... C25B 9/70 205/516
(Continued)

FOREIGN PATENT DOCUMENTS

CN 1435510 A 8/2003
CN 105102691 A 11/2015
(Continued)

OTHER PUBLICATIONS

Hirofumi Iisaka, U.S. Appl. No. 17/495,362, filed Oct. 6, 2021.
(Continued)

*Primary Examiner* — Katherine A Bareford
(74) *Attorney, Agent, or Firm* — Dickinson Wright, PLLC

(57) ABSTRACT

A method that forms a metal plating film having a thick film thickness by a solid phase method is provided. The present disclosure is a method that forms the metal plating films of a first metal and a second metal having an ionization tendency larger than an ionization tendency of the first metal. The method includes: depositing the second metal on a surface of a copper base material to form the plating film of the second metal; and depositing the first metal on a surface of the second metal by a solid electroless plating method to form the plating film of the first metal. The solid electroless plating method in the depositing of the first metal is performed using a laminated complex. The laminated complex includes a first substitution-type electroless plating bath, a solid electrolyte membrane, a copper base material, a third metal, a second substitution-type electroless plating bath, and an insulating polymer. The first substitution-type electroless plating bath contains ions of the first metal. The second metal is plated on the copper base material. The third metal has an ionization tendency larger than the ionization
(Continued)

tendency of the first metal. The second substitution-type electroless plating bath contains ions of the first metal.

7 Claims, 7 Drawing Sheets

(51) Int. Cl.

| | |
|---|---|
| ***C23C 28/02*** | (2006.01) |
| ***C23C 18/34*** | (2006.01) |
| ***C23C 18/44*** | (2006.01) |
| ***C23C 18/16*** | (2006.01) |

(52) U.S. Cl.
CPC ..... *C23C 18/42* (2013.01); *C23C 18/44* (2013.01); *C23C 18/54* (2013.01)

(56) References Cited

U.S. PATENT DOCUMENTS

| | | | | |
|---|---|---|---|---|
| 4,999,054 | A * | 3/1991 | Perovetz | C23C 18/44 106/3 |
| 9,677,185 | B2 | 6/2017 | Sato et al. | |
| 2003/0150353 | A1 | 8/2003 | Kato et al. | |
| 2004/0192030 | A1* | 9/2004 | Redeker | H01L 21/288 257/E21.174 |
| 2010/0109651 | A1 | 5/2010 | Tolmachev et al. | |
| 2010/0155108 | A1* | 6/2010 | Lee | H05K 3/244 174/254 |
| 2011/0042816 | A1 | 2/2011 | Fujiwara et al. | |
| 2012/0225361 | A1 | 9/2012 | Wang et al. | |
| 2016/0024675 | A1 | 1/2016 | Hiraoka et al. | |
| 2016/0076162 | A1 | 3/2016 | Sato et al. | |
| 2019/0110367 | A1* | 4/2019 | Gavagnin | H05K 3/4682 |
| 2020/0407853 | A1 | 12/2020 | Iisaka | |

FOREIGN PATENT DOCUMENTS

| | | | |
|---|---|---|---|
| JP | 4-118456 U | * | 10/1992 |
| JP | 2001-196641 | * | 7/2001 |
| JP | 2005-109126 A | | 4/2005 |
| JP | 2005109126 A | | 4/2005 |
| JP | 2005307309 A | | 11/2005 |
| JP | 2009-283364 A | | 12/2009 |
| JP | 2011042831 A | | 3/2011 |
| JP | 2016023338 A | | 2/2016 |
| JP | 2018-035426 | * | 3/2018 |

OTHER PUBLICATIONS

U.S. Non-Final Office Action dated Jun. 17, 2022, which issued in the corresponding U.S. Appl. No. 16/907,468.
U.S. Final Office Action dated Feb. 3, 2022, which issued in the corresponding U.S. Appl. No. 16/907,468.
U.S. Non-Final Office Action dated Oct. 21, 2021, which issued in the corresponding U.S. Appl. No. 16/907,468.
U.S. Advisory Action dated May 16, 2022, which issued in the corresponding U.S. Appl. No. 16/907,468.
U.S. Advisory Action dated Jan. 23, 2023, which issued in the corresponding U.S. Appl. No. 16/907,468.
U.S. Final Office Action dated Nov. 7, 2022, which issued in the corresponding U.S. Appl. No. 16/907,468.
Hirofumi Iisaka, U.S. Appl. No. 16/907,468, Non-Final Office Action dated Mar. 2, 2023.

* cited by examiner

METHOD FOR FORMING METAL PLATING FILM

CROSS REFERENCE TO RELATED APPLICATIONS

The present application claims priority from Japanese patent application JP 2019-filed on Sep. 13, 2019, the entire content of which is hereby incorporated by reference into this application.

BACKGROUND

Technical Field

The present disclosure relates to a method for forming a metal plating film (also simply referred to as a "film" in this specification or the like).

Description of Related Art

Generally, a method for plating by reducing metal ions in a plating bath (here, the "plating bath" is also referred to as a "plating solution") is roughly divided into an electroplating method using an external current and an electroless plating method not using an external electricity. The latter electroless plating method is further roughly divided into (1) a substitution-type electroless plating method where metal ions in a solution are reduced by electrons, which are released by dissolution of an object to be plated, and deposited on the object to be plated, and (2) an autocatalytic reduction-type electroless plating method where metal ions in a solution are deposited as a metal film by electrons released when a reducing agent contained in the solution is oxidized. Since the electroless plating method ensures uniform deposition even on a surface in a complicated shape, the electroless plating method is widely used in many fields.

In the substitution-type electroless plating, a difference in ionization tendency between a metal in a plating bath and an underlying metal is used to form a metal plating film. For example, in a gold plating method, when a substrate on which an underlying metal is formed is immersed in a plating bath, the underlying metal having a high ionization tendency becomes ions to be dissolved in the plating bath, and gold ions in the plating bath are deposited on the underlying metal as a metal to form a gold plating film. The substitution-type electroless plating is widely used mainly for oxidation prevention of an underlying material metal and a foundation of autocatalytic-type plating.

For example, JP 2005-307309 A discloses a substitution-type electroless plating bath using the substitution-type electroless plating method. JP 2005-307309 A discloses an electroless gold plating bath to form a gold plating film on an electroless nickel plating film, and the electroless gold plating bath contains (a) a water-soluble gold compound, (b) a conductive salt containing an acidic substance having an acid dissociation constant (pKa) of 2.2 or less, and (c) an oxidation inhibitor containing a heterocyclic aromatic compound having two or more nitrogen atoms in a molecule as essential components.

JP 2011-42831 A discloses a manufacturing method of a semiconductor apparatus using an electroless plating method. In JP 2011-42831 A, to manufacture the semiconductor apparatus including a surface electrode on a semiconductor substrate, the method includes a step of forming a metal electrode film on a surface of the semiconductor substrate and a plating layer formation step of forming a nickel plating layer on a surface of the metal electrode film by an electroless nickel plating process. A concentration of elements of sodium and potassium remaining on the surface of the metal electrode film before the plating layer formation step is $9.20\times10^{14}$ atoms/cm$^2$ or less in total, and a concentration of elements of sodium and potassium contained in an electroless nickel plating bath used for the electroless nickel plating process is 3400 wtppm or less in total.

SUMMARY

The formation of the metal plating film by an electroplating method has an advantage of fast film forming rate. On the other hand, in the formation of the metal plating film by the electroplating method, uniform metal film formation is difficult. For example, to form a gold plating film on nickel, a substitution reaction between the nickel and gold generates local corrosion and therefore the uniform gold film formation is difficult, resulting in reduced solder wettability.

The formation of the metal plating film by the electroless plating method has an advantage that allows the uniform metal film formation. On the other hand, in the formation of the metal plating film by the electroless plating method, the film forming rate is slow and therefore obtaining a thick film thickness is difficult, resulting in high cost. This is because when a foundation is covered with a metal by the electroless plating method, a deposition reaction of the metal stops and the maximum film thickness becomes only around 0.2 μm.

Therefore, nowadays, a solid phase method that allows forming the metal plating film at a high speed has been gathering attention.

The present disclosure provides a method that forms a metal plating film having a thick film thickness by the solid phase method.

A Solid Electro Deposition (SED) method is a method, in which a solid electrolyte membrane is disposed between an anode and a base material serving as a cathode, and the solid electrolyte membrane is brought into contact with the base material, and then a voltage is applied between the anode and the base material, and a metal is deposited on a surface of the base material from metal ions contained inside the solid electrolyte membrane to form a metal plating film made of the metal on the surface of the base material.

A Solid Electroless Deposition (SELD) method includes a solid substitution-type electroless plating method and a solid reduction-type electroless plating method. The solid substitution-type electroless plating method is a method, in which a solid electrolyte membrane is installed between a substitution-type electroless plating bath containing ions of a first metal and a second metal having an ionization tendency larger than that of the first metal (or the second metal plated on a metal base material) and the first metal is deposited on a surface of the second metal by causing a redox reaction derived from a difference in the ionization tendency between the metals, which are the first metal in an ionic state that have passed through the solid electrolyte membrane and the second metal as an underlying metal, to form a metal plating film made of the first metal on the surface of the second metal. The solid reduction-type electroless plating method is a method, in which a solid electrolyte membrane is installed between a reduction-type electroless plating bath containing ions of a second metal and a metal base material and the second metal is deposited on a surface of the metal base material by causing a redox reaction between the ions of the second metal that have passed through the solid electrolyte membrane and a reductant contained in the reduction-type electroless plating bath to form a plating film of the second metal on the surface of the metal base material.

Therefore, as a result of intensive studies, the inventor has found the following. In a method in which a first metal is deposited on a surface of a second metal, which has an ionization tendency larger than those of the first metal and copper and is plated on a copper base material, by a solid electroless plating method to form a metal plating film, a third metal having an ionization tendency larger than that of the second metal is disposed on a surface not in contact with a solid electrolyte membrane of the copper base material in a complex formed of a first substitution-type electroless plating bath containing ions of a first metal, the copper base material on which the second metal is plated, and the solid electrolyte membrane installed between the substitution-type electroless plating bath and the second metal, that is, a surface on which the second metal is not plated of the copper base material, such that a second substitution-type electroless plating bath containing the ions of the first metal is present on an interface between the copper base material and the third metal, and further an insulating polymer is disposed on a surface of the third metal not in contact with the copper base material or the second substitution-type electroless plating bath in the third metal. Accordingly, a local cathode reaction of the first metal is generated by a local anode reaction of the third metal, a substitution reaction between the first metal and the second metal is promoted, and a plating film of the first metal having a thick film thickness can be formed, thus completing the present disclosure.

That is, the gist of the present disclosure is as follows.

(1) A method of the present disclosure forms metal plating films of a first metal and a second metal having an ionization tendency larger than an ionization tendency of the first metal. The method comprises: depositing the second metal on a surface of a copper base material to form the plating film of the second metal; and depositing the first metal on a surface of the second metal by a solid electroless plating method to form the plating film of the first metal. The solid electroless plating method in the depositing of the first metal is performed using a laminated complex. The laminated complex includes a first substitution-type electroless plating bath, a solid electrolyte membrane, a copper base material on which the second metal is plated, a third metal, a second substitution-type electroless plating bath, and an insulating polymer. The first substitution-type electroless plating bath contains ions of the first metal. The solid electrolyte membrane is disposed so as to be in contact with the first substitution-type electroless plating bath. The copper base material on which the second metal is plated is disposed such that the solid electrolyte membrane is in contact with the second metal. The third metal is disposed so as to be in contact with a surface not in contact with the solid electrolyte membrane of the copper base material on which the second metal is plated, that is, a surface on which the second metal is not plated of the copper base material. The second substitution-type electroless plating bath contains ions of the first metal and is present in an interface between the copper base material on which the second metal is plated and the third metal. The insulating polymer is disposed so as to be in contact with a surface of the third metal not in contact with the copper base material on which the second metal is plated or the second substitution-type electroless plating bath in the third metal.

Here, the first metal, the second metal, the third metal, and the copper base material have an ionization tendency with magnitudes of the third metal>the second metal>the copper base material>the first metal.

(2) In the method according to (1), the depositing of the second metal is performed by a solid electro deposition method.

(3) The method according to (1) is as follows. The depositing of the second metal is performed by the solid electroless plating method. The solid electroless plating method in the depositing of the second metal is performed using a laminated complex. The laminated complex includes a first reduction-type electroless plating bath, a solid electrolyte membrane, the copper base material, the third metal, a second reduction-type electroless plating bath, and the insulating polymer. The first reduction-type electroless plating bath contains ions of the second metal. The solid electrolyte membrane is disposed so as to be in contact with the first reduction-type electroless plating bath. The copper base material is disposed so as to be in contact with the solid electrolyte membrane. The third metal is disposed so as to be in contact with the surface not in contact with the solid electrolyte membrane of the copper base material, that is, the surface on which the second metal is not to be plated of the copper base material. The second reduction-type electroless plating bath contains ions of the second metal and is present in an interface between the copper base material and the third metal. The insulating polymer is disposed so as to be in contact with the surface of the third metal not in contact with the copper base material or the second reduction-type electroless plating bath in the third metal.

(4) The method according to any one of (1) to (3) is as follows. The first metal has a standard electrode potential (X) of $0.337\ V<X\leq 1.830\ V$. The second metal has a standard electrode potential (Y) of $-0.277\ V\leq Y<0.337\ V$. The third metal has a standard electrode potential (Z) of $-3.045\ V\leq Z<-0.277\ V$.

(5) In the method according to any one of (1) to (4), the third metal is aluminum or iron.

(6) In the method according to any one of (1) to (5), the first metal is gold.

(7) In the method according to any one of (1) to (6), the second metal is nickel.

(8) The method according to any one of (1) to (3) is as follows. The first metal is gold. The second metal is nickel. The third metal is aluminum. A weight ratio of the aluminum to the copper base material (aluminum/copper base material) in contact with one another in a same area in the depositing of the first metal is from 0.100 to 2.000.

(9) A method of the present disclosure deposits a second metal on a surface of a copper base material by a solid electroless plating method to form a plating film of the second metal. The solid electroless plating method is performed using a laminated complex. The laminated complex includes a first reduction-type electroless plating bath, a solid electrolyte membrane, a copper base material, a third metal, a second reduction-type electroless plating bath, and an insulating polymer. The first reduction-type electroless plating bath contains ions of the second metal. The solid electrolyte membrane is disposed so as to be in contact with the first reduction-type electroless plating bath. The copper base material is disposed so as to be in contact with the solid electrolyte membrane. The third metal has an ionization tendency larger than an ionization tendency of the second metal and is disposed so as to be in contact with a surface not in contact with the solid electrolyte membrane of the copper base material, that is, the surface on which the second metal is not to be plated of the copper base material. The second reduction-type electroless plating bath contains ions of the second metal and is present in an interface between the copper base material and the third metal. The insulating polymer is disposed so as to be in contact with a surface of the third metal not in contact with the copper base material or the second reduction-type electroless plating bath in the third metal.

(10) A laminated complex of the present disclosure is that for depositing a first metal on a surface of a second metal plated on a copper base material by a solid electroless plating method to form a metal plating film. The laminated complex comprises a first substitution-type electroless plating bath that contains ions of the first metal, a solid electrolyte membrane disposed so as to be in contact with the first substitution-type electroless plating bath, a copper base material on which a second metal is plated that is disposed such that the solid electrolyte membrane is in contact with the second metal, a third metal disposed so as to be in contact with a surface not in contact with the solid electrolyte membrane of the copper base material on which the second metal is plated, that is, a surface on which the second metal is not plated of the copper base material, a second substitution-type electroless plating bath containing ions of the first metal that is present in an interface between the copper base material on which the second metal is plated and the third metal, and an insulating polymer disposed so as to be in contact with a surface of the third metal not in contact with the copper base material on which the second metal is plated or the second substitution-type electroless plating bath in the third metal.

Here, the first metal, the second metal, the third metal, and the copper base material have an ionization tendency with magnitudes of the third metal>the second metal>the copper base material>the first metal.

Effects

The present disclosure provides the method that forms the metal plating films having thick film thicknesses by the solid phase method.

DETAILED DESCRIPTION OF THE EMBODIMENTS

Figure 1:
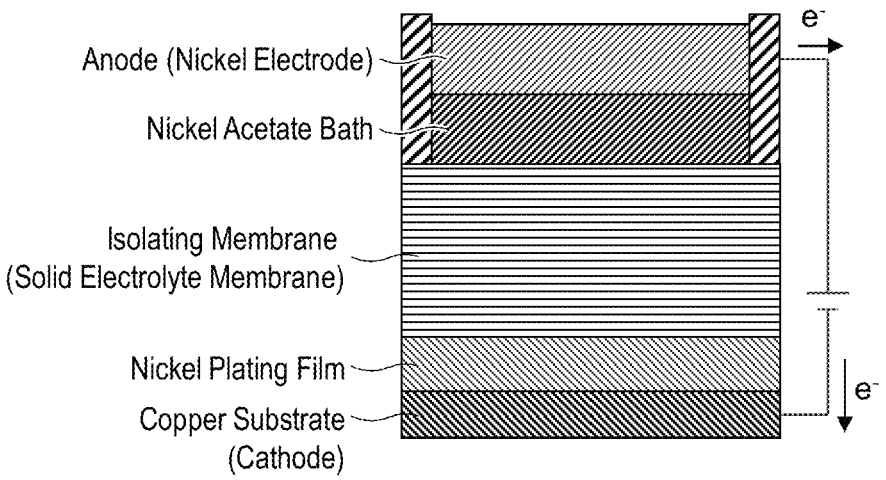
FIG. 1 is a drawing schematically illustrating an example of film formation of a plating film of nickel by a solid electro deposition method when the nickel is used as a second metal and a copper substrate is used as a copper base material in a first step of the present disclosure.

The following describes preferred embodiments of the present disclosure in detail. In this specification, features of the present disclosure will be described with reference to the drawings as necessary. In the drawings, dimensions and shapes of respective components are exaggerated for clarification, and actual dimensions and shapes are not accurately illustrated. Accordingly, the technical scope of the present disclosure is not limited to the dimensions and the shapes of the respective components illustrated in the drawings. Note that, a method for forming a metal plating film of the present disclosure is not limited to the embodiments bellow, and can be performed in various configurations where changes, improvements, and the like which a person skilled in the art can make are given without departing from the gist of the present disclosure.

The present disclosure relates to a method that forms metal plating films of a first metal and a second metal having an ionization tendency larger than an ionization tendency of the first metal. The method includes: a first step of depositing the second metal on a surface of a copper base material to form the plating film of the second metal; and a second step of depositing the first metal on a surface of the second metal by a solid electroless plating method to form the plating film of the first metal. The solid electroless plating method in the second step is performed using a laminated complex. The laminated complex includes a first substitution-type electroless plating bath, a solid electrolyte membrane, a copper base material on which the second metal is plated, a third metal, a second substitution-type electroless plating bath, and an insulating polymer. The first substitution-type electroless plating bath contains ions of the first metal. The solid electrolyte membrane is disposed so as to be in contact with the first substitution-type electroless plating bath. The copper base material on which the second metal is plated is disposed such that the solid electrolyte membrane is in contact with the second metal. The third metal is disposed so as to be in contact with a surface not in contact with the solid electrolyte membrane of the copper base material on which the second metal is plated, that is, the surface on which the second metal is not plated of the copper base material. The second substitution-type electroless plating bath contains ions of the first metal and is present in an interface between the copper base material on which the second metal is plated and the third metal. The insulating polymer is disposed so as to be in contact with a surface of the third metal not in contact with the copper base material on which the second metal is plated or the second substitution-type electroless plating bath in the third metal. Here, the first metal, the second metal, the third metal, and the copper base material have an ionization tendency with magnitudes of the third metal>the second metal>the copper base material>the first metal.

Here, it is inferred that reactions described below occur in the second step as a feature of the present disclosure, and as a result, effects of the present disclosure can be obtained. Note that the present disclosure is not limited to the following inference.

When the solid electrolyte membrane containing the first substitution-type electroless plating bath containing the ions of the first metal is brought into contact with the plating film of the second metal having the ionization tendency larger than that of the first metal, the plating film of the second metal becomes ions and dissolves into the first substitution-type electroless plating bath. Meanwhile, in a reaction in which the ions of the first metal derived from the first substitution-type electroless plating bath are reduced and deposited on the surface of the plating film of the second metal to form the plating film of the first metal, the third metal having the ionization tendency larger than those of the copper base material and the second metal is brought into contact with the surface on which the plating film of the second metal is not formed of the copper base material on which the plating film of the second metal is formed to form a local cell between the second metal and the third metal. As a result, a local anode reaction of the third metal progresses, electrons generated by the reaction induce a local cathode reaction of the first metal on the second metal. In association with this, a substitution reaction between the first metal and the second metal, that is, the film formation of the first metal on the plating film of the second metal is promoted, and the plating film of the first metal having a thick film thickness is uniformly formed.

Additionally, in the surface on which the plating film of the second metal is not formed of the copper base material on which the plating film of the second metal is formed, when the copper base material, the third metal having the ionization tendency larger than that of the second metal and the second substitution-type electroless plating bath containing the ions of the first metal are brought into contact with each other, because of an effect of an interposition of liquid in an assembly interface of the dissimilar metals, a Fermi level of the copper base material has the same value as that of the third metal. Accordingly, the electrons generated in the local anode reaction in which the third metal becomes ions and is dissolved in the second substitution-type electroless plating bath can move without strong binding by atomic nuclei in the respective metals. As a result, the electrons induce the local cathode reaction of the first metal on the second metal. In association with this, the substitution reaction between the first metal and the second metal, that is, the film formation of the first metal on the plating film of the second metal is promoted, and the plating film of the first metal having a thick film thickness is uniformly formed.

(Copper Base Material)

With the present disclosure, the copper base material is a base material made of copper or an alloy containing copper. The copper base material can have any shape. The shape of the copper base material includes, for example, a plate-shaped object, such as a flat plate shape or a curved plate shape, a rod-shaped object, or a spherical-shaped object. The copper base material may be an object on which fine processing, such as a groove and a hole, is performed, and may be, for example, a wiring for an electronic industrial component, such as a printed wiring board, an ITO substrate, and a ceramic IC package substrate. The copper base material may be a plating film formed on a resin product, a glass product, or a product, such as a ceramic component. The copper base material may be a copper substrate made of copper.

When the copper base material is the plate-shaped object, an average thickness of the copper base material is usually from 0.1 mm to 30 mm and may be from 0.5 mm to 3 mm.

(First Metal)

With the present disclosure, the first metal has the ionization tendency smaller than those of the second metal, the third metal, and the copper base material.

The standard electrode potential (X) [V vs NHE] of the first metal is usually $0.337\ V<X\leq 1.830\ V$.

Examples of the first metal include gold, palladium, rhodium, and silver. From a perspective of absence of a surface-oxidized film as a basic condition of assembly, ease of deformation because of its flexibility, and ease of avoidance of an interface void, the first metal may be gold.

(Second Metal)

With the present disclosure, the second metal has the ionization tendency larger than those of the first metal and the copper base material and the ionization tendency smaller than that of the third metal.

The standard electrode potential (Y) [V vs NHE] of the second metal is usually $-0.277\ V\leq Y<0.337\ V$ and may be $-0.257\ V\leq Y<0.337\ V$.

Examples of the second metal include lead, tin, and nickel. From a perspective of undercoat plating, in other words, a barrier layer, in an electronic component, the second metal may be nickel.

(Third Metal)

With the present disclosure, the third metal has the ionization tendency larger than those of the first metal, the second metal, and the copper base material. Note that the third metal includes an alloy containing two or more kinds of metals.

The standard electrode potential (Z) [V vs NHE] of the third metal is usually $-3.045\ V\leq Z<-0.277\ V$ and may be $-2.714\ V\leq Z\leq -0.338\ V$.

Examples of the third metal include magnesium, beryllium, aluminum, titanium, zirconium, manganese, zinc, and iron. From a perspective of ease of procurement and processing, the third metal may be aluminum or iron. The third metal may be aluminum.

The third metal can have any shape according to the shape of the copper base material. The shape of the third metal includes, for example, a plate-shaped object, such as a flat plate shape or a curved plate shape.

As described later, when the third metal is the plate-shaped object, although an average thickness of the third metal in the second step possibly depends on a weight ratio of the third metal to the copper base material (third metal/copper base material) in contact with one another in the same area, the average thickness is usually from 0.1 mm to 30 mm, and may be from 0.5 mm to 20 mm.

(First Step)

With the present disclosure, in the first step, the second metal is deposited on the surface of the copper base material to form the plating film of the second metal.

In the first step, the method that deposits the second metal on the surface of the copper base material to form the plating film of the second metal is not limited, and the known technique in the technical field, such as an electroplating method and an electroless plating method, is usable. In the first step, the method that deposits the second metal on the surface of the copper base material to form the plating film of the second metal may be a solid phase method or may be a solid electro deposition method and a solid electroless deposition method.

An example of using the solid electro deposition method in the first step will be described with reference to FIG. 1.

FIG. 1 schematically illustrates an example of the film formation of the plating film of nickel by the solid electro deposition method when the nickel is used as the second metal and the copper substrate is used as the copper base material in the first step. In FIG. 1, the solid electrolyte membrane as an isolating film is disposed between a nickel electrode as an anode and the copper substrate as a cathode, and the solid electrolyte membrane is brought into contact with the copper substrate. A voltage is applied between the nickel electrode and the copper substrate, and nickel is deposited on the surface of the copper substrate from a nickel acetate plating bath as a plating bath for electrodeposition containing nickel ions contained inside the solid electrolyte membrane to form a nickel plating film made of the nickel on the surface of the copper substrate. As the solid electrolyte membrane, a solid electrolyte membrane that will be described later (second step) can be used.

In the first step, to use the solid electro deposition method, a reaction temperature (temperature of a plating bath chamber) is usually from 25° C. to 70° C. and may be from 40° C. to 65° C., a reaction time (plating time) is usually from 30 seconds to 1 hour and may be from 1 minute to 30 minutes, and a pressure applied between the anode and the cathode is usually from 0.1 MPa to 3 MPa and may be from 0.3 MPa to 1 MPa. Setting the reactive conditions in the ranges allows the film formation at an appropriate deposition rate and allows suppressing decomposition of components in the plating bath.

In the first step, to deposit the second metal on the surface of the copper base material by the solid reduction-type electroless plating method and form the plating film of the second metal, a metal (for example, the third metal) having the ionization tendency larger than that of the second metal and the reduction-type electroless plating bath containing the ions of the second metal are brought into contact with a surface on which the second metal is not to be plated of the copper base material (here, the reduction-type electroless plating bath containing the ions of the second metal is present in an interface between the surface on which the second metal is not to be plated of the copper base material and the metal having the ionization tendency larger than that of the second metal), and further the insulating polymer may be brought into contact with a surface not in contact with the copper base material of the metal having the ionization tendency larger than that of the second metal. Accordingly, a local cell can be formed between the copper base material and the metal having the ionization tendency larger than that of the second metal, and the formation of the plating film of the second metal on the copper base material can be promoted. Note that as the solid electrolyte membrane and the insulating polymer that can be used for the solid reduction-type electroless plating method, a solid electrolyte membrane and an insulating polymer that will be described later (second step) can be used.

For example, in the first step, to form the nickel plating film by depositing the nickel on the surface of the copper substrate by the solid reduction-type electroless plating method using nickel as the second metal and using the copper substrate as the copper base material, aluminum having an ionization tendency larger than that of the nickel and a second reduction-type electroless plating bath containing ions of the nickel are brought into contact with a surface not in contact with the solid electrolyte membrane of the copper substrate in a complex formed of a first reduction-type electroless plating bath containing ions of the nickel, the copper substrate, and the solid electrolyte membrane installed between the first reduction-type electroless plating bath and the copper substrate, that is, a surface on which the nickel is not to be plated (here, the second reduction-type electroless plating bath containing the ions of the nickel is present in an interface between a surface on which the nickel is not to be plated of the copper substrate and the aluminum). Further, PTFE as the insulating polymer is brought into contact with a surface not in contact with the copper substrate of the aluminum. This allows forming a local cell between the copper substrate and the aluminum, and a local anode reaction of the aluminum allows promoting a local cathode reaction of the nickel, that is, the formation of the plating film of the nickel on the copper substrate, thus ensuring uniformly forming the nickel plating film with increased weight (having the thick film thickness). In this respect, as the first or second reduction-type electroless plating bath containing the ions of the nickel, an electroless nickel-phosphorus alloy plating bath can be used, and in the case of using the plating bath, a nickel-phosphorus plating film is formed.

Deposition reaction of electroless nickel-phosphorus alloy plating bath (solid reduction-type electroless plating method)

$$H_2PO_2^- + H_2O \rightarrow HPO_3^{2-} + 2H^+ + \tfrac{1}{2}H_2 + e^-$$

$$Ni^{2+} + 2e^- \rightarrow Ni$$

$$2Ni^{2+} + H_2PO_2^- + 2H^+ + 5e^- \rightarrow Ni_2P + 2H_2O$$

$$H^+ + e^- \rightarrow \tfrac{1}{2}H_2$$

In the first step, to use the solid reduction-type electroless plating method, a reaction temperature (temperature of a plating bath chamber) is usually from 60° C. to 95° C. and may be from 70° C. to 90° C., a reaction time (plating time) is usually from 30 seconds to 1 hour and may be from 1 minute to 30 minutes, and a pressure applied between the plating bath chamber, which houses the first reduction-type electroless plating bath containing the ions of the second metal, and the copper base material or the insulating polymer is usually from 0.1 MPa to 3 MPa and may be from 0.3 MPa to 1 MPa. Setting the reactive conditions in the ranges allows the film formation at an appropriate deposition rate and allows suppressing decomposition of components in the plating bath.

Note that the plating film of the second metal deposited in the first step may be amorphous or may be crystalline, and in the case of the crystalline, the plating film may be, for example, an equiaxed or columnar crystal. For example, in the first step, when the nickel as the second metal is formed on the copper base material by the solid electro deposition method, the nickel is deposited as the nickel columnar crystal. For example, in the first step, when the nickel as the second metal is formed on the copper base material by the solid electroless plating method, the nickel is deposited as amorphous nickel.

In the first step, the use of the solid phase method, especially, the solid electro deposition method or the solid electroless plating method allows forming the metal plating film having a thick film thickness at a high speed.

In the first step, an average film thickness of the second metal plated on the copper base material is usually from 2 μm to 50 μm and may be from 5 μm to 30 μm. Note that the average film thickness is a value found by averaging film thicknesses at 10 positions measured with, for example, a microscope image.

(Second Step)

With the present disclosure, in the second step, the first metal is deposited on the surface of the second metal by the solid electroless plating method to form the plating film of the first metal.

Here, the solid electroless plating method in the second step is performed using a laminated complex. The laminated complex includes a first substitution-type electroless plating bath, a solid electrolyte membrane, a copper base material on which a second metal is plated, a third metal, a second substitution-type electroless plating bath, and an insulating polymer. The first substitution-type electroless plating bath contains ions of the first metal. The solid electrolyte membrane is disposed so as to be in contact with the first substitution-type electroless plating bath. The copper base material on which the second metal is plated is disposed such that the solid electrolyte membrane is in contact with the second metal. The third metal is disposed so as to be in contact with a surface not in contact with the solid electrolyte membrane of the copper base material on which the second metal is plated, that is, the surface on which the second metal is not plated of the copper base material. The second substitution-type electroless plating bath contains ions of the first metal and is present in an interface between the copper base material on which the second metal is plated and the third metal. The insulating polymer is disposed so as to be in contact with a surface of the third metal not in contact with the copper base material on which the second metal is plated or the second substitution-type electroless plating bath in the third metal.

(Substitution-Type Electroless Plating Bath)

With the present disclosure, the substitution-type electroless plating bath is a plating solution used in the substitution-type electroless plating method. The substitution-type electroless plating bath, for example, contains a metal compound containing the ions of the first metal and a complexing agent and may contain an additive as necessary. Examples of the additive include a pH buffer agent or a stabilizer. A commercially available substitution-type electroless plating bath may be used.

The first substitution-type electroless plating bath is housed in a plating bath chamber. The plating bath chamber is made of, for example, a metallic material or a resin material and has an opening to bring the first substitution-type electroless plating bath into contact with the solid electrolyte membrane. Accordingly, the solid electrolyte membrane is disposed in the opening of the plating bath chamber. Note that since the first substitution-type electroless plating bath is housed in a space constituted by the plating bath chamber and the solid electrolyte membrane, oxidization of the substitution-type electroless plating bath can be suppressed. Therefore, an oxidation inhibitor may not to be added to the substitution-type electroless plating bath. Additionally, sealing the substitution-type electroless plating bath with the plating bath chamber and the solid electrolyte membrane ensures facilitating eutectoid of hydrogen in the plating film, and as a result, solder wettability can be improved.

The substitution-type electroless plating bath is, for example, a substitution-type electroless plating bath in which the first metal is gold, that is, a substitution-type electroless gold plating bath. Hereinafter, the substitution-type electroless gold plating bath will be described in detail.

The substitution-type electroless gold plating bath at least contains a gold compound and a complexing agent and may contain an additive as necessary. Note that since the substitution-type electroless gold plating bath does not contain a reductant, management and an operation of the bath are comparatively easy.

While the gold compound is not specifically limited, the gold compound includes, for example, a cyanide gold salt or a non-cyanide gold salt. The cyanide gold salt includes a gold cyanide, a gold potassium cyanide, a gold sodium cyanide, a gold ammonium cyanide, or the like. The non-cyanide gold salt includes a gold sulfite salt, a gold thiosulfate salt, a chloroaurate, a gold thiomalate, or the like. One kind of gold salt may be used alone, or two or more kinds may be used in combination. As the gold salt, from the aspect of handling, environment, and toxicity, the non-cyanide gold salt may be used, and the gold sulfite salt among the non-cyanide gold salt may be used. The gold sulfite salt can include, for example, a gold ammonium sulfite, a gold potassium sulfite, a gold sodium sulfite, a methanesulfonic acid gold salt, or the like.

Content of the gold compound in the substitution-type electroless gold plating bath as gold is usually from 0.5 g/L to 2.5 g/L and may be from 1.0 g/L to 2.0 g/L. The respective upper limit values and lower limit values of these numerical ranges can be combined among them as necessary to specify an appropriate range. When the content of the gold is 0.5 g/L or more, the deposition reaction of the gold can be improved. Additionally, when the content of the gold is 2.5 g/L or less, stability of the substitution-type electroless gold plating bath can be improved.

The complexing agent provides effects to stably complex gold ions ($Au^+$) and to decrease the occurrence of a disproportionation reaction of $Au^+$ ($3Au^+ \rightarrow Au^{3+} + 2Au$), thereby improving the stability of the substitution-type electroless gold plating bath. One kind of the complexing agent may be used alone, or two or more kinds may be used in combination.

The complexing agent includes, for example, a cyanide complexing agent or a non-cyanide complexing agent. The cyanide complexing agent includes, for example, sodium cyanide or potassium cyanide. The non-cyanide complexing agent includes, for example, sulfite, thiosulfate, thiomalate, thiocyanate, mercaptosuccinic acid, mercaptoacetic acid, 2-mercaptopropionic acid, 2-aminoethanethiol, 2-mercaptoethanol, glucose cysteine, 1-thioglycerol, sodium mercaptopropane sulfonate, N-acetyl methionine, thiosalicylic acid, ethylenediaminetetraacetic acid (EDTA), and pyrophosphoric acid. As the complexing agent, from the aspect of handling, environment, and toxicity, the non-cyanide complexing agent may be used, and the sulfite among the non-cyanide complexing agent may be used.

The content of the complexing agent in the substitution-type electroless gold plating bath is usually from 1 g/L to 200 g/L, and may be from 20 g/L to 50 g/L. The respective upper limit values and lower limit values of these numerical ranges can be combined among them as necessary to specify an appropriate range. When the content of the complexing agent is 1 g/L or more, a gold complexing ability is increased to ensure improvement in the stability of the substitution-type electroless gold plating bath. When the content of the complexing agent is 200 g/L or less, generation of recrystallization in the substitution-type electroless gold plating bath can be suppressed.

The substitution-type electroless gold plating bath can contain the additive as necessary. The additive includes, for example, a pH buffer or a stabilizer.

The pH buffer can adjust a deposition rate to a desired value, and can keep pH of the substitution-type electroless gold plating bath constant. One kind of the pH buffer may be used alone, or two or more kinds may be used in combination. The pH buffer includes, for example, phosphate, acetate, carbonate, borate, citrate, or sulfate.

The pH of the substitution-type electroless gold plating bath is usually from 5.0 to 8.0, may be from 6.0 to 7.8, and may be from 6.8 to 7.5. The respective upper limit values and lower limit values of these numerical ranges can be combined among them as necessary to specify an appropriate range. When the pH is 5.0 or more, the stability of the substitution-type electroless gold plating bath tends to be improved. When the pH is 8.0 or less, corrosion of the metal base material as the underlying metal can be suppressed. The pH can be adjusted by adding, for example, potassium hydroxide, sodium hydroxide, and ammonium hydroxide.

The stabilizer can improve the stability of the substitution-type electroless gold plating bath. The stabilizer includes, for example, a thiazole compound, a bipyridyl compound, or a phenanthroline compound.

A commercially available substitution-type electroless plating bath may be used. The commercial product includes, for example, EPITHAS TDS-25, TDS-20 (manufactured by C. Uyemura & Co., Ltd.), or FLASH GOLD (manufactured by OKUNO CHEMICAL INDUSTRIES CO., LTD.).

With the present disclosure, as the substitution-type electroless plating bath, the first substitution-type electroless plating bath containing the ions of the first metal and the second substitution-type electroless plating bath containing the ions of the first metal are used. The first substitution-type electroless plating bath containing the ions of the first metal and the second substitution-type electroless plating bath containing the ions of the first metal may be the same or different. The first substitution-type electroless plating bath containing the ions of the first metal and the second substitution-type electroless plating bath containing the ions of the first metal may be the same.

(Solid Electrolyte Membrane)

With the present disclosure, the solid electrolyte membrane is not especially limited as long as the solid electrolyte membrane brought into contact with the first substitution-type electroless plating bath containing the ions of the first metal can internally impregnate the ions of the first metal and the ions of the first metal can pass on the surface of the second metal by the solid electroless plating method.

The solid electrolyte membrane may be a porous film and have an anionic group. When the solid electrolyte membrane is the porous film having the anionic group, the anionic group can capture the ions of the second metal dissolved from the second metal. Therefore, the deterioration of the substitution-type electroless plating bath due to the ions of the second metal (for example, nickel ions) derived from the second metal can be suppressed. Since the porous film having the anionic group is hydrophilic, the wettability is improved. Therefore, since the porous film having the anionic group is easily wettable by the substitution-type electroless plating bath, the substitution-type electroless plating bath can be uniformly spread on the second metal. Consequently, the porous film having the anionic group provides an effect that the uniform metal plating film can be formed.

While the anionic group is not specifically limited, the anionic group is at least one kind selected from, for example, a sulfonic acid group, a thiosulfonic acid group (—$S_2O_3H$), a carboxyl group, a phosphoric acid group, a phosphonic acid group, a hydroxyl group, a cyano group, or a thiocyano group. These anionic groups can capture ions of metal having positive electric charges. These anionic groups can give the hydrophilicity to the porous film. The anionic group may be a sulfonic acid group or a carboxyl group. Especially, the anionic group may be a sulfonic acid group (sulfo group) because nickel ions can be effectively captured.

As a material of the porous film having the anionic group, an anionic polymer can be used. That is, the porous film having the anionic group contains the anionic polymer. The anionic polymer has the anionic group (for example, the sulfonic acid group, the thiosulfonic acid group, the carboxyl group, the phosphoric acid group, the phosphonic acid group, the hydroxyl group, the cyano group, or the thiocyano group described above). The anionic polymer may have one kind of the anionic group alone, or may have two kinds or more of the anionic groups in combination. The anionic group may be the sulfonic acid group.

While the anionic polymer is not specifically limited, the anionic polymer can contain, for example, a polymer containing a monomer having the anionic group.

Representatively, the anionic polymer includes, for example, a polymer having the carboxyl group [for example, a (meth)acrylic acid polymer (for example, a copolymer of (meth)acrylic acid, such as poly(meth)acrylic acid, and another copolymerizable monomer), or a fluorine-based resin having the carboxyl group (perfluorocarboxylic acid resin)], a styrene-based resin having the sulfonic acid group [for example, polystyrene sulfonic acid], and a sulfonated polyarene ether-based resin [for example, sulfonated polyether ketone resin and sulfonated polyethersulfone resin].

The solid electrolyte membrane internally has an ion cluster structure, and the substitution-type electroless plating bath is impregnated to inside the ion cluster structure. Since the ions of the first metal, such as gold ions, in the substitution-type electroless plating bath are coordinated to the anionic group in the solid electrolyte membrane, the ions of the first metal are effectively diffused into the solid electrolyte membrane. Therefore, the use of the solid electrolyte membrane ensures the formation of the uniform metal plating film.

The solid electrolyte membrane has a porous structure (that is, ion cluster structure), and pores of the porous structure are very small, having an average pore diameter of usually from 0.1 μm to 100 μm. By applying a pressure, the substitution-type electroless plating bath can be impregnated into the solid electrolyte membrane. While the solid electrolyte membrane can include, for example, a fluorine-based resin, such as Nafion (registered trademark) manufactured by DuPont, a hydrocarbon-based resin, a polyamic acid resin, and a resin having an ion exchange function, such as Selemion (CMV, CMD, CMF series) manufactured by AGC Inc., the solid electrolyte membrane is not limited to them. The solid electrolyte membrane may be the fluorine-based resin having a sulfonic acid group. The fluorine-based resin having the sulfonic acid group has a hydrophobic part of a fluorinated carbon skeleton and a hydrophilic part of a side chain part having the sulfonic acid group, and these parts form the ion cluster. The ions of the first metal in the substitution-type electroless plating bath impregnated to inside the ion cluster are coordinated to the sulfonic acid group of the solid electrolyte membrane, and uniformly diffused into the solid electrolyte membrane. Since the solid electrolyte membrane having the sulfonic acid group is easily wettable by the substitution-type electroless plating bath because of high hydrophilicity and excellent wettability, the substitution-type electroless plating bath can be uniformly spread on the second metal. Therefore, the use of the fluorine-based resin having the sulfonic acid group ensures the formation of the uniform metal plating film. Furthermore, the use of the fluorine-based resin having the sulfonic acid group increases dielectric polarization generated at a diffusion layer present between the solid electrolyte membrane and the second metal due to Maxwell-Wagner effect, thus ensuring high speed transport of the ions of the first metal. Such a fluorine-based resin is available as, for example, a series of a product name "Nafion" from DuPont.

The Equivalent Weight (EW) of the solid electrolyte membrane is usually from 850 g/mol to 950 g/mol, and may be from 874 g/mol to 909 g/mol. The respective upper limit values and lower limit values of these numerical ranges can be combined among them as necessary to specify an appropriate range. Here, the equivalent weight means a dry mass of the solid electrolyte membrane per equivalent of an ion exchange group. When the equivalent weight of the solid electrolyte membrane is in this range, the uniformity of the metal plating film can be improved.

While an adjustment method of the equivalent weight of the solid electrolyte membrane is not specifically limited, for example, in the case of a perfluorocarbon sulfonic acid polymer, the adjustment can be performed by changing a polymerization ratio between a fluorinated vinyl ether compound and a fluorinated olefin monomer. Specifically, for example, by increasing the polymerization ratio of the fluorinated vinyl ether compound, the equivalent weight of the solid electrolyte membrane to be obtained can be decreased. The equivalent weight can be measured using a titration method.

A film thickness of the solid electrolyte membrane is usually from 10 μm to 200 μm and may be from 20 μm to 160 μm. The respective upper limit values and lower limit values of these numerical ranges can be combined among them as necessary to specify an appropriate range. When the film thickness of the solid electrolyte membrane is 10 μm or more, the solid electrolyte membrane is not easily broken and has an excellent durability. When the film thickness of the solid electrolyte membrane is 200 μm or less, the pressure necessary for causing the substitution-type electroless plating bath to pass through the solid electrolyte membrane can be reduced.

A water contact angle of the solid electrolyte membrane is usually 15° or less, may be 13° or less, and may be 10° or less. When the water contact angle of the solid electrolyte membrane is within this range, the wettability of the solid electrolyte membrane can be improved.

(Relationship Between Copper Base Material and Third Metal)

With the present disclosure, in the second step, to use aluminum as the third metal, a weight ratio of the aluminum to the copper base material in contact with one another in the same area (aluminum/copper base material) is usually from 0.100 to 2.000 and may be from 0.128 to 1.743.

(Insulating Polymer)

With the present disclosure, the insulating polymer is a polymer that does not flow electricity. Although not especially limited, examples of the insulating polymer include polyolefin, such as polypropylene (PP), engineering plastics, such as polyamide (PA) and polyphenylene sulfide (PPS), elastomer, such as fluorine rubber and silicon rubber, and thermosetting resin, such as unsaturated polyester. The insulating polymer can have any shape according to the shape of the copper base material and the shape of the third metal. The insulating polymer is a plate-shaped object having, for example, a flat plate shape or a curved plate shape.

In the solid substitution-type electroless plating method in the second step, a reaction temperature (temperature of a plating bath chamber) is usually from 60° C. to 95° C. and may be from 70° C. to 90° C., a reaction time (plating time) is usually from 30 seconds to 1 hour and may be from 1 minute to 30 minutes, and a pressure applied between the plating bath chamber housing the first substitution-type electroless plating bath containing the ions of the first metal and the insulating polymer is usually from 0.1 MPa to 3 MPa and may be from 0.3 MPa to 1 MPa. Setting the reactive conditions in the ranges allows the film formation at an appropriate deposition rate and allows suppressing decomposition of components in the plating bath.

The solid substitution-type electroless plating method in the second step will be described with reference to FIGS. 2 and 3.

Figure 2:
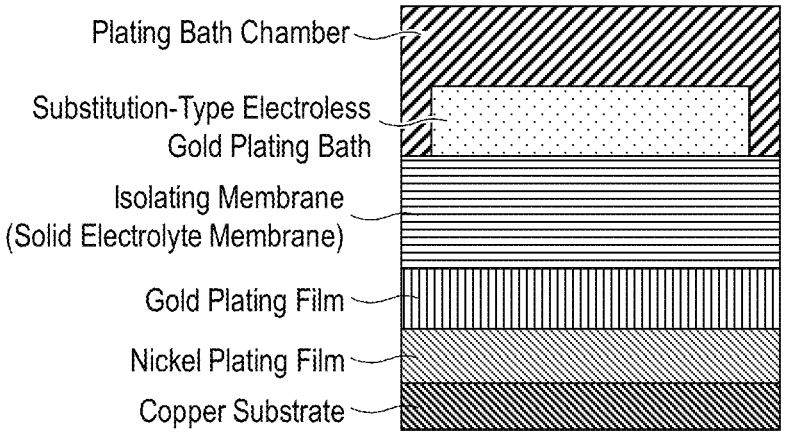
FIG. 2 is a drawing schematically illustrating an example of film formation of a gold plating film on a nickel plating film on a copper substrate by a conventional solid substitution-type electroless plating method.

FIG. 2 schematically illustrates an example of film formation of the gold plating film on the nickel plating film on the copper substrate in a case where gold is used as the first metal, nickel is used as the second metal, and the copper substrate is used as the copper base material in the conventional solid substitution-type electroless plating method. FIG. 2 illustrates the first substitution-type electroless gold plating bath, the solid electrolyte membrane as an isolating membrane disposed so as to be in contact with the first substitution-type electroless gold plating bath, and the copper substrate on which nickel is plated that is disposed such that the solid electrolyte membrane is in contact with the nickel. Gold ions that have passed through the solid electrolyte membrane cause a redox reaction with the nickel as the underlying metal derived from a difference in ionization tendency between the gold and the nickel, and the gold is deposited on the surface of the nickel. Thus, the plating film made of the gold is formed on the surface of the nickel plating film (between the nickel plating film and the solid electrolyte membrane).

Figure 3:
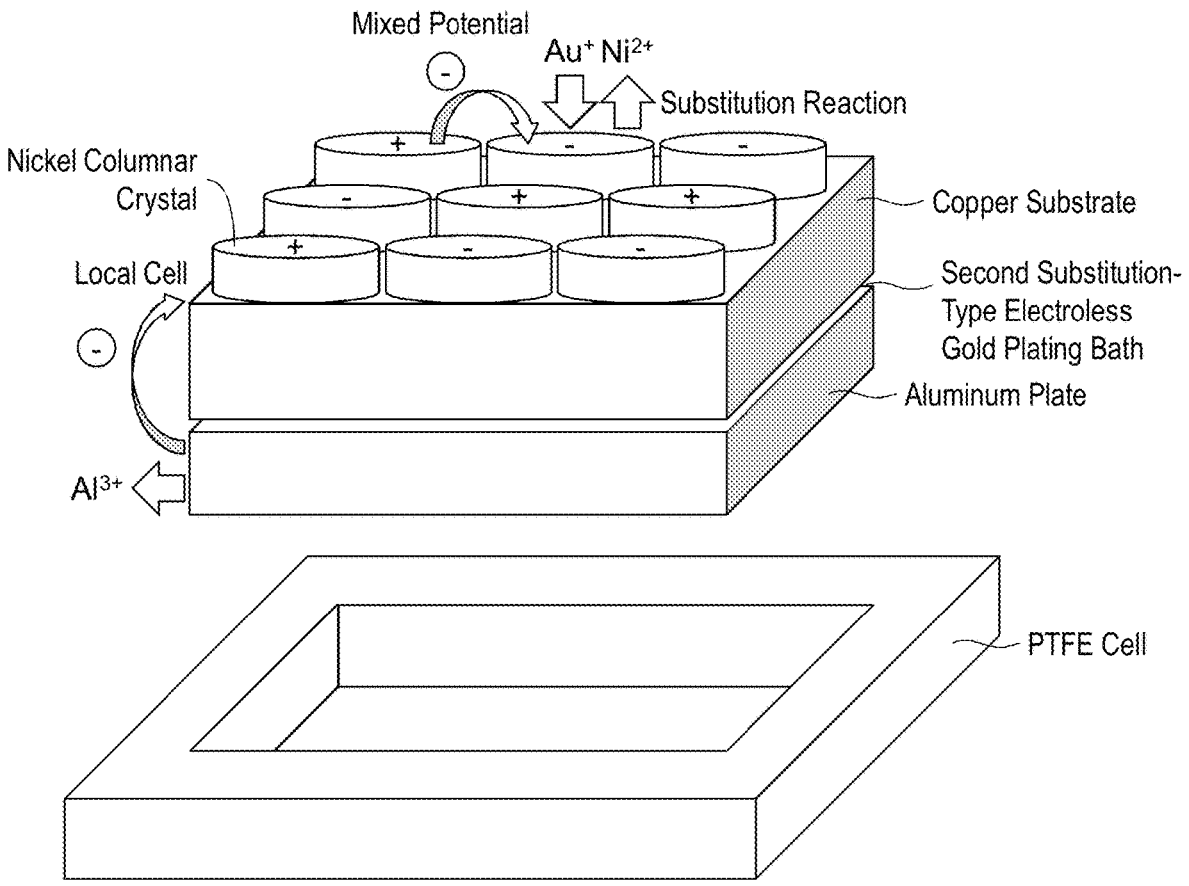
FIG. 3 is a drawing schematically illustrating an example of film formation of a gold plating film on a nickel plating film on a copper substrate by a solid substitution-type electroless plating method when gold is used as a first metal, a nickel columnar crystal is used as a second metal, aluminum is used as a third metal, a PTFE cell is used as an insulating polymer, and the copper substrate is used as a copper base material in a second step of the present disclosure.

FIG. 3 schematically illustrates an example of the film formation of the gold plating film on the nickel plating film on the copper substrate by the solid substitution-type electroless plating method in a case where gold is used as the first metal, a nickel columnar crystal (formed from the nickel plating film by the solid electro deposition method in the first step) is used as the second metal, aluminum (aluminum plate) is used as the third metal, a PTFE cell is used as the insulating polymer, and the copper substrate is used as the copper base material in the second step of the present disclosure. In addition to the first substitution-type electroless gold plating bath containing the gold ions, the solid electrolyte membrane as the isolating membrane disposed so as to be in contact with the first substitution-type electroless gold plating bath, and the copper substrate on which the nickel is plated that is disposed such that the solid electrolyte membrane is in contact with the nickel illustrated in FIG. 2, FIG. 3 illustrates a state in which an aluminum plate is disposed so as to be in contact with the surface not in contact with the solid electrolyte membrane of the copper substrate on which the nickel is plated, that is, the surface on which the nickel is not plated of the copper substrate, the second substitution-type electroless gold plating bath containing the ions of the first metal is dropped on an interface between the copper substrate on which the nickel is plated and the aluminum plate, and the PTFE cell as the insulating polymer is disposed on a surface of the aluminum plate not in contact with the copper substrate on which the nickel is plated or the second substitution-type electroless gold plating bath in the aluminum plate.

From the example of the film formation of the gold plating film illustrated in FIG. 3, it is inferred that a reaction described below occurs. As a result, the effect of the present disclosure, in which the gold plating film having the thick film thickness is uniformly formed on the nickel plating film, can be obtained. Note that the present disclosure is not limited to the following inference.

When the solid electrolyte membrane containing the first substitution-type electroless gold plating bath is brought into contact with the plating film of the nickel having the ionization tendency larger than that of the gold, the plating film of the nickel becomes ions and dissolved in the first substitution-type electroless gold plating bath. Meanwhile, in a reaction in which the gold ions derived from the first substitution-type electroless gold plating bath are reduced and deposited on the surface of the plating film of the nickel to form the plating film of the gold, the aluminum plate having the ionization tendency larger than that of the nickel and the copper substrate are brought into contact with each other at the surface on which the plating film of the nickel is not formed of the copper substrate on which the plating film of the nickel is formed to form a local cell between the nickel and the aluminum. A local anode reaction of the aluminum plate occurs in the local cell and the electrons generated by the reaction flow from the aluminum plate to the nickel plating film via the copper substrate, and therefore a proportion of the supply of the electrons to the nickel plating film increases. As a result, a local cathode reaction of the gold on the nickel is induced, and in association with this, the substitution reaction between the gold and the nickel, that is, the film formation of the gold plating film on the nickel plating film, is promoted, thereby ensuring uniformly forming the gold plating film having the thick film thickness.

Figure 4:
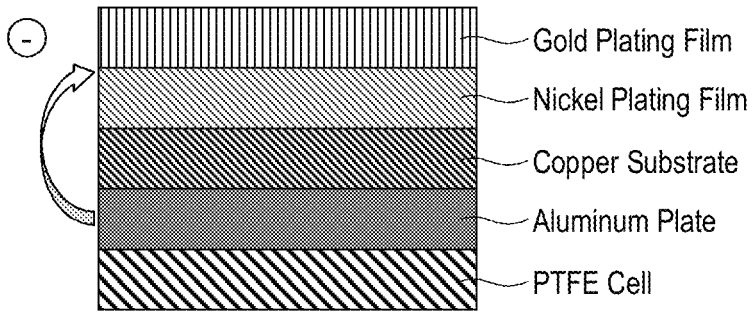
FIG. 4 is a drawing schematically illustrating a movement of electrons from an aluminum plate as the third metal to the nickel as the second metal in the second step of the present disclosure.

Furthermore, when the copper substrate, the aluminum plate having the ionization tendency larger than that of the nickel, and the second substitution-type electroless gold plating bath containing the gold ions are brought into contact with each other at the surface on which the plating film of the nickel is not formed of the copper substrate on which the plating film of the nickel is formed, because of an effect of an interposition of liquid in an assembly interface of the dissimilar metals, a Fermi level of the copper substrate has the same value as that of the aluminum plate. Accordingly, the electrons generated in the local anode reaction in which the aluminum plate becomes ions and is dissolved in the second substitution-type electroless gold plating bath can move without strong binding by atomic nuclei in the respective metals. As a result, the electrons induce the local cathode reaction of the gold on the nickel. In association with this, a substitution reaction between the gold and the nickel, that is, the film formation of the gold plating film on the nickel plating film, is promoted, and the gold plating film having the thick film thickness is uniformly formed. FIG. 4 schematically illustrates the movement of the electrons from the aluminum plate as the third metal to the nickel as the second metal. Note that although an oxidized film is formed on the aluminum plate before in contact with the copper substrate or the second substitution-type electroless gold plating bath, when the aluminum plate is brought into contact with the copper substrate and the second substitution-type electroless gold plating bath, the dissolution of the aluminum plate proceeds by the local anode reaction, and therefore the oxidized film is absent in the aluminum plate after in contact with the copper substrate and the second substitution-type electroless gold plating bath.

Additionally, when the nickel is the nickel columnar crystal, a difference in an amount of defect between the respective crystals in the nickel columnar crystal generates an electric potential difference between the crystals to produce mixed potential, and thus the substitution reaction between the gold and the nickel is promoted. More specifically, a lattice defect is present in the nickel plating film of the nickel columnar crystal manufactured by the solid electro deposition method in the first step, and with respect to an agglomeration of the lattice defects, a degenerated defect level in the band theory is formed. Crystal grains of the nickel plating film manufactured by the solid electro deposition method each have different amounts of lattice defect. Accordingly, the respective crystal grains have different electric potential differences, and it can be considered that countless cells, in which the positive part as the cathode part and the negative part as the anode part are formed, are present on the nickel plating film (mixed potential theory of electroless plating). When the substitution reaction between the nickel and the gold starts, the cathode parts or the anode parts are not fixed, and while the electrons move from the anode parts to the cathode parts, the reaction proceeds until the entire outermost surface of the nickel deposition is substituted by the gold (substitution reaction).

[Substitution Reaction]

$$Au^{+}+e^{-}\rightarrow Au(+1.830\ V)$$

$$Ni\rightarrow Ni^{2+}+2e^{-}(-0.257\ V) \qquad \text{[Substitution Reaction]}$$

[Local Cathode Reaction]

$$Au^{+}+e^{-}\rightarrow Au(+1.830\ V) \qquad \text{[Local Cathode Reaction]}$$

[Local Anode Reaction]

$$Al\rightarrow Al^{3+}+3e^{-}(-1.680\ V) \qquad \text{[Local Anode Reaction]}$$

Note that in the local cell, because of the difference in ionization tendency between the two kinds of metals, the noble part of the electric potential (small ionization tendency) becomes the cathode and the base part of the electric potential (large ionization tendency) becomes the anode, and thus a current flows. Note that, for example, a difference in magnitude of strain or magnitude of the metal crystal grains, a difference in orientation of the crystals, or a weight ratio also becomes a cause of the local cell, simply not only the difference in the magnitude of the ionization tendency of the mutual metals. Since the local cell is in a state of being short-circuited by metal phases, the local current flows.

In the second step, the average film thickness of the first metal plated on the second metal is usually from 0.01 μm to 25 μm and may be from 0.2 μm to 2.5 μm. Note that the average film thickness is a value found by averaging film thicknesses at 10 positions measured with, for example, a microscope image or a SEM image.

Furthermore, the present disclosure relates to the laminated complex for depositing the first metal on the surface of the second metal plated on the copper base material by the solid electroless plating method to form the metal plating film. The laminated complex includes the first substitution-type electroless plating bath, the solid electrolyte membrane, the copper base material on which the second metal is plated, the third metal, the second substitution-type electroless plating bath, and the insulating polymer. The first substitution-type electroless plating bath contains the ions of the first metal. The solid electrolyte membrane is disposed so as to be in contact with the first substitution-type electroless plating bath. The copper base material on which the second metal is plated is disposed such that the solid electrolyte membrane is in contact with the second metal. The third metal is disposed so as to be in contact with the surface not in contact with the solid electrolyte membrane of the copper base material on which the second metal is plated, that is, the surface on which the second metal is not plated of the copper base material. The second substitution-type electroless plating bath contains the ions of the first metal and is present in the interface between the copper base material on which the second metal is plated and the third metal. The insulating polymer is disposed so as to be in contact with the surface of the third metal not in contact with the copper base material on which the second metal is plated or the second substitution-type electroless plating bath in the third metal. Here, the first metal, the second metal, the third metal, and the copper base material have the ionization tendency with magnitudes of the third metal>the second metal>the copper base material>the first metal.

The respective components of the laminated complex of the present disclosure are as described above.

To deposit the first metal on the surface of the second metal plated on the copper base material by the solid electroless plating method and form the metal plating film, the use of the laminated complex of the present disclosure provides an effect that the metal plating film can be formed by the use of a small amount of the plating bath. That is, the conventional electroless plating method generally immerses an object to be plated in the plating bath to form a plating film on the object to be plated. To immerse the object to be plated in the plating bath, a comparatively large amount of plating bath may be used. Meanwhile, the amount of plating bath to be used in the laminated complex of the present disclosure is actually only the amount impregnated into the solid electrolyte membrane and therefore the amount is smaller than the conventional amount used to immerse the object to be plated. Therefore, the method according to the present disclosure allows forming the metal plating film by the use of the small amount of the plating bath.

A plating laminated member body including the copper base material, the second metal formed on the copper base material, and the first metal formed on the second metal manufactured in the present disclosure can be used, for example, as a power element upper electrode.

EXAMPLES

While the present disclosure will be further described in detail using the examples and a comparative example below, the technical scope of the present disclosure is not limited to them.

Preparation of Specimens

Example 1

(First Step)

Nickel as the second metal was deposited on a surface of a copper substrate as the copper base material by the solid electro deposition method under the following conditions to form a nickel plating film.

<Film Formation Conditions by Solid Electro Deposition Method with Nickel>

Temperature: 60° C.

Current×time: 150 mA×200 seconds

Area: 10 mm×20 mm

Anode: foamed nickel electrode

Copper base material (cathode): copper substrate (18 mm×35 mm×3 mm)

Nickel plating bath: 0.95M—nickel chloride+0.05 M—nickel acetate aqueous solution (pH 4.0)

Pressure: 1 MPa

Solid electrolyte membrane: Nafion NRE212 (manufactured by Dupon)

Pretreatment to copper substrate:

(1) Defat: alkaline degreaser×55° C.×5 minutes (2) Acid activation: fluoride-containing activator×room temperature (20° C. to 30° C.)×1 minute (Second Step)

Gold as the first metal was deposited on a surface of the nickel as the second metal by the solid substitution-type electroless plating method under the following conditions to form a gold plating film.

<Film Formation Conditions by Solid Substitution-Type Electroless Plating Method with Gold>

Temperature: 75° C.

Film formation time: 30 minutes

Area: 10 mm×20 mm

Pressure: 0.3 MPa

Base material: nickel plating film (solid electro deposition method)/copper substrate Solid electrolyte membrane: Nafion N-115 (manufactured by Dupon)

First and second substitution-type electroless gold plating baths: TDS-25 (manufactured by C. Uyemura & Co., Ltd.)

Third metal: aluminum plate

Insulating polymer: PTFE cell

Weight ratio of the aluminum plate to the copper substrate in contact with one another in the same area (aluminum plate/copper substrate): 0.001

Example 2

In Example 1, except that the weight ratio of the aluminum plate to the copper substrate in contact with one another in the same area (aluminum plate/copper substrate) was changed to 0.128, a gold plating film was formed similarly to Example 1.

Example 3

In Example 1, except that the weight ratio of the aluminum plate to the copper substrate in contact with one another in the same area (aluminum plate/copper substrate) was changed to 0.216, a gold plating film was formed similarly to Example 1.

Example 4

In Example 1, except that the weight ratio of the aluminum plate to the copper substrate in contact with one another in the same area (aluminum plate/copper substrate) was changed to 0.237, a gold plating film was formed similarly to Example 1.

Example 5

In Example 1, except that the weight ratio of the aluminum plate to the copper substrate in contact with one another in the same area (aluminum plate/copper substrate) was changed to 0.581, a gold plating film was formed similarly to Example 1.

Example 6

In Example 1, except that the weight ratio of the aluminum plate to the copper substrate in contact with one another in the same area (aluminum plate/copper substrate) was changed to 1.162, a gold plating film was formed similarly to Example 1.

Example 7

In Example 1, except that the weight ratio of the aluminum plate to the copper substrate in contact with one another in the same area (aluminum plate/copper substrate) was changed to 1.743, a gold plating film was formed similarly to Example 1.

Example 8

In Example 1, except that the weight ratio of the aluminum plate to the copper substrate in contact with one another in the same area (aluminum plate/copper substrate) was changed to 2.116, a gold plating film was formed similarly to Example 1.

Example 9

In Example 1, except that an iron plate was used as the third metal and the weight ratio of the iron plate to the copper substrate in contact with one another in the same area (iron plate/copper substrate) was changed to 0.731, a gold plating film was formed similarly to Example 1.

Example 10

(First Step)

Nickel as the second metal was deposited on a surface of a copper substrate as the copper base material by the solid reduction-type electroless plating method under the following conditions to form a nickel plating film.

<Film Formation Conditions by Solid Reduction-Type Electroless Plating Method with Nickel>

Temperature: 75° C.

Film formation time: 30 minutes

Area: 10 mm×20 mm

Pressure: 0.3 MPa

Copper base material: copper substrate (18 mm×35 mm×3 mm)

Reduction-type electroless nickel plating bath: electroless nickel-phosphorus alloy plating bath, NPR-18 (manufactured by C. Uyemura & Co., Ltd.)

Solid electrolyte membrane: Nafion N-115 (manufactured by Dupon)

Metal brought into contact with the surface on which the nickel is not to be plated of the copper substrate: aluminum plate Insulating polymer brought into contact with the surface not in contact with the copper substrate of the aluminum plate: PTFE cell Reduction-type electroless nickel plating bath to be dropped on an interface between the copper substrate and the aluminum plate: electroless nickel-phosphorus alloy plating bath, NPR-18 (manufactured by C. Uyemura & Co., Ltd.)

Pretreatment to the copper substrate:

(1) Defat: alkaline degreaser×55° C.×5 minutes (2) Acid activation: fluoride-containing activator×room temperature (20° C. to 30° C.)×1 minute (Second Step)

Gold as the first metal was deposited on a surface of the nickel as the second metal by the solid substitution-type electroless plating method under the following conditions to form a gold plating film.

<Film Formation Conditions by Solid Substitution-Type Electroless Plating Method with Gold>

Temperature: 75° C.

Film formation time: 30 minutes

Area: 10 mm×20 mm

Pressure: 0.3 MPa

Base material: nickel plating film (solid reduction-type electroless plating method)/copper substrate Solid electrolyte membrane: Nafion N-115 (manufactured by Dupon)

First and second substitution-type electroless gold plating baths: TDS-25 (manufactured by C. Uyemura & Co., Ltd.)

Third metal: aluminum plate

Insulating polymer: PTFE cell

Weight ratio of the aluminum plate to the copper substrate in contact with one another in the same area (aluminum plate/copper substrate): 0.001

Comparative Example 1

(First Step)

Nickel as the second metal was deposited on a surface of a copper substrate as the copper base material by the electroless plating method under the following conditions to form a nickel plating film.

<Film Formation Conditions by Electroless Plating Method with Nickel>

Temperature: 75° C.

Film formation time: 30 minutes

Area: 10 mm×20 mm

Pressure: 0.3 MPa

Copper base material: copper substrate (18 mm×35 mm×3 mm)

Solid electrolyte membrane: Nafion N-115 (manufactured by Dupon)

Nickel plating bath: Top Nicoron TOM-LF (manufactured by C. Uyemura & Co., Ltd.)

Pretreatment to the copper substrate:

(1) Defat: alkaline degreaser×55° C.×5 minutes (2) Acid activation: fluoride-containing activator×room temperature (20° C. to 30° C.)×1 minute (Second Step)

Gold as the first metal was deposited on a surface of the nickel as the second metal by the solid electroless deposition method using the substitution-type electroless gold plating bath under the following conditions to form a gold plating film.

<Film Formation Conditions by Substitution-Type Electroless Plating Method with Gold>

Temperature: 75° C.

Film formation time: 30 minutes

Area: 10 mm×20 mm

Pressure: 0.3 MPa

Substrate: nickel plating film (electroless plating method)/copper substrate

Substitution-type electroless gold plating bath: TDS-25 (manufactured by C. Uyemura & Co., Ltd.)

[Evaluations]

Figure 5:
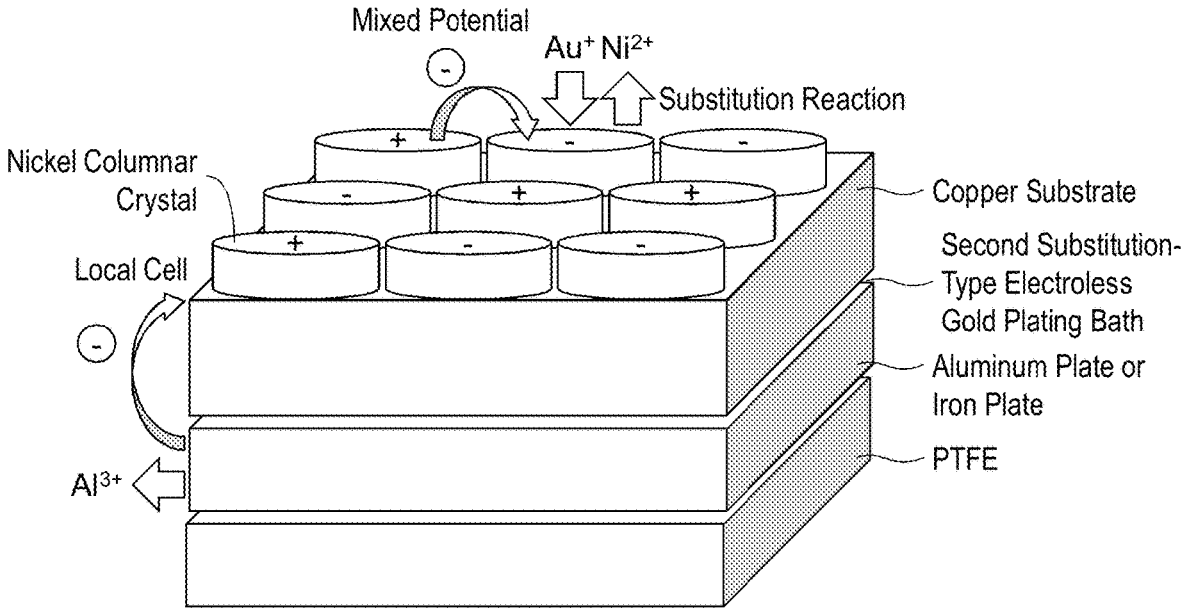
FIG. 5 is a drawing schematically illustrating film formation of a gold plating film on a nickel columnar crystal plating film by the solid substitution-type electroless plating method in Examples 1 to 9.
Figure 6:
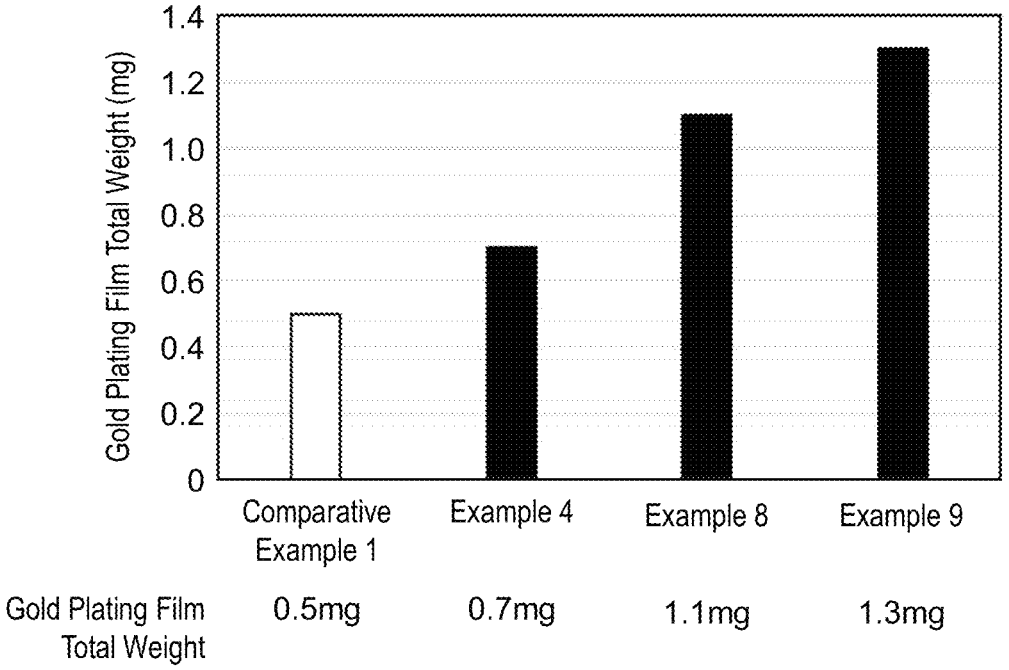
FIG. 6 is a graph illustrating total weights of gold plating films in Comparative Example 1, Example 4, Example 8, and Example 9.
Figure 7:
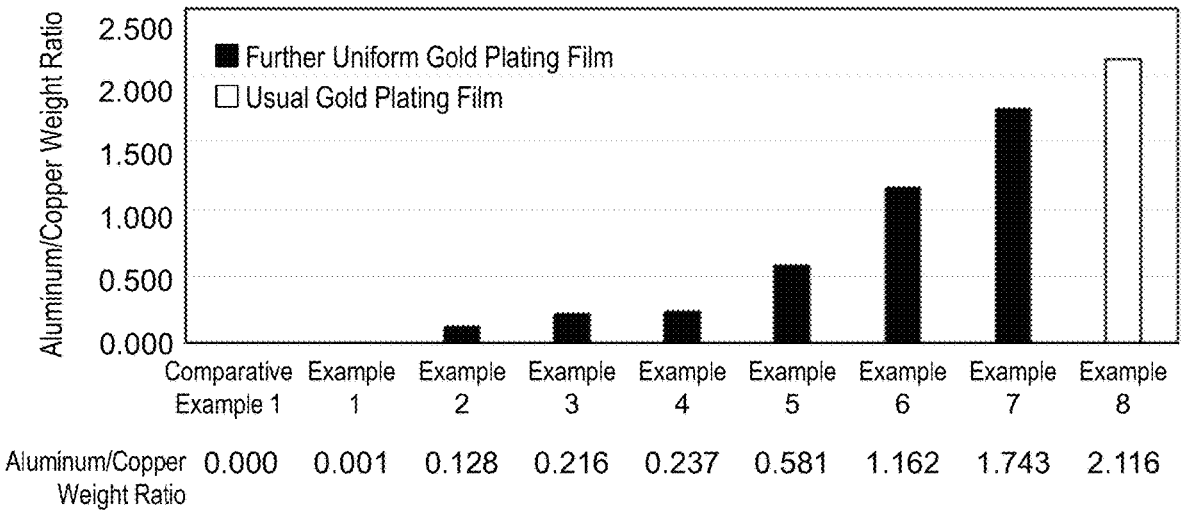
FIG. 7 is a graph illustrating a relationship between weight ratios of aluminum plates to copper substrates (aluminum plates/copper substrates) and states of the gold plating films of Comparative Example 1 and Examples 1 to 8.

FIG. 5 schematically illustrates film formation of a gold plating film on a nickel columnar crystal plating film by the solid substitution-type electroless plating method in Examples 1 to 9, FIG. 6 illustrates total weights of gold plating films in Comparative Example 1, Example 4, Example 8, and Example 9, and FIG. 7 illustrates a relationship between weight ratios of aluminum plates to copper substrates (aluminum plates/copper substrates) in contact with one another in the same area and states of the gold plating films of Comparative Example 1 and Examples 1 to 8.

In FIG. 6, Example 4 (aluminum plate/copper substrate weight ratio=0.237) had the total weight of the gold plating film larger than that of Comparative Example 1, and Example 8 (aluminum plate/copper substrate weight ratio=2.116) and Example 9 (iron plate/copper substrate weight ratio=0.731) had the total weights of the gold plating films larger than that of Example 4. Accordingly, the following has been found. In the method in which the gold is deposited on the surface of the nickel plated on the copper substrate by the solid substitution-type electroless plating method to form the gold plating film, the aluminum or the iron having the ionization tendency larger than that of the nickel is disposed on the surface on which the nickel plating film is not plated of the copper substrate in the complex formed of the first substitution-type electroless plating bath, the copper substrate on which the nickel is plated, and the solid electrolyte membrane installed between the substitution-type electroless plating bath and the nickel plating film such that the second substitution-type electroless plating bath is present on the interface between the copper substrate and the aluminum plate or the iron plate, and further the PTFE is disposed on the surface of the aluminum plate or the iron plate not in contact with the copper substrate or the second substitution-type electroless plating bath in the aluminum plate or the iron plate. Accordingly, the local cathode reaction of the gold is generated by the local anode reaction of the aluminum plate or the iron plate, and the substitution reaction between the gold and the nickel is promoted, and the gold plating films having the large total weights, that is, the gold plating films having the thick film thickness can be formed.

Additionally, the total weight of the nickel plating film after the first step in Example 10 was 4.4 mg. Meanwhile, in the first step of Example 10, when the PTFE cell was brought in contact with the surface on which the nickel was not plated of the copper substrate while not being brought in contact with the aluminum plate or the reduction-type electroless nickel bath, the total weight of the nickel plating film after the first step became 1.5 mg. Accordingly, it has been found that when the solid reduction-type electroless plating method is used in the first step, bringing the aluminum plate in contact with the surface on which the nickel is not to be plated of the copper substrate allows an increase in weight of the nickel plating film. Furthermore, the total weight of the plating films of the nickel and the gold after the second step in Example 10 was 5.7 mg. Accordingly, the total weight of the gold plating films was 1.3 mg.

Further, it has been found from FIG. 7 that, in the second step, when the weight ratio of the aluminum plate to the copper substrate in contact with one another in the same area (aluminum plate/copper substrate) is from 0.100 to 2.000, especially from 0.128 to 1.743, the formed gold plating films become more uniform.

All documents, patents and patent publications cited in the present description are herein incorporated by reference as they are.

What is claimed is:

1. A method that forms metal plating films of a first metal and a second metal having an ionization tendency larger than an ionization tendency of the first metal, the method comprising:

depositing the second metal on a surface of a copper base material to form the plating film of the second metal; and depositing the first metal on a surface of the second metal by a solid electroless plating method to form the plating film of the first metal, wherein the solid electroless plating method in the depositing of the first metal is performed using a complex, the complex comprising a first substitution electroless plating bath, a solid electrolyte membrane having a thickness of 10 μm to 200 μm, the copper base material on which the second metal is plated, a third metal, a second substitution electroless plating bath, and an insulating polymer, the first substitution-electroless plating bath contains ions of the first metal, the solid electrolyte membrane is disposed so as to be in contact with the first substitution electroless plating bath, the copper base material on which the second metal is plated is disposed such that the solid electrolyte membrane is in contact with the second metal, the third metal is disposed so as to be in contact with a surface not in contact with the solid electrolyte membrane of the copper base material on which the second metal is plated, the second substitution electroless plating bath contains ions of the first metal and is present in an interface between and contacts the copper base material and a first side of the third metal, and the insulating polymer is disposed so as to be in contact with a surface on a second side of the third metal that is not in contact with the copper base material on which the second metal is plated or the second substitution electroless plating bath, and wherein the first metal, the second metal, the third metal, and the copper base material have an ionization tendency with magnitudes of the third metal>the second metal>the copper base material>the first metal;

wherein the depositing of the second metal is performed by a solid electro deposition method, wherein the first metal is gold, the second metal is nickel, the third metal is aluminum, and a weight ratio of the aluminum to the copper base material (aluminum/copper base material) in contact with one another in a same area in the depositing of the first metal is from 0.128 to 1.743.

2. The method according to claim 1, wherein said copper base material consists of copper or an alloy containing copper and has a thickness of 0.1 mm to 30 mm.

3. The method according to claim 1, wherein said copper base material consists of copper or an alloy containing copper and has a thickness of 0.5 mm to 3 mm.

4. The method according to claim 1, wherein said third metal has a thickness of 0.1 to 30 mm.

5. The method according to claim 1, wherein said second metal on the surface of the copper base material has a thickness of 2 μm to 50 μm.

6. The method according to claim 1, wherein said solid electrolyte membrane has a thickness of 20 μm to 160 μm.

7. The method according to claim 1, wherein said first metal on the surface of said second metal has a thickness of 0.01 μm to 25 μm.

* * * * *